United States Patent [19]

Torralba

[11] 4,055,978

[45] Nov. 1, 1977

[54] PROCEDURE FOR MANUFACTURING HYDRAULIC PLUNGER-TYPE PUMP BODIES

[75] Inventor: Jose Esteban Torralba, Zaragoza, Spain

[73] Assignee: Talleres Diesel, S.A., Zaragoza, Spain

[21] Appl. No.: 671,476

[22] Filed: Mar. 29, 1976

[30] Foreign Application Priority Data

Apr. 10, 1975 Spain ..... 436492

[51] Int. Cl.[2] ..... B21K 1/26

[52] U.S. Cl. ..... 72/254; 29/156.4 R

[58] Field of Search ..... 29/156.4 R, 180 A, 180 E; 418/179; 417/DIG. 1; 72/254, 264, 253

[56] References Cited

U.S. PATENT DOCUMENTS

| | | | |
|---|---|---|---|
| 2,188,423 | 1/1940 | Andrews | 29/180 E |
| 3,661,480 | 5/1972 | Forschner et al. | 29/156.4 |

OTHER PUBLICATIONS

Modern Metals, vol. 5, Issue 12, p. 17, Jan. 1950.

*Primary Examiner*—Lowell A. Larson
*Attorney, Agent, or Firm*—Eyre, Mann, Lucas & Just

[57] ABSTRACT

Pump bodies are formed by cutting sections from hollow drawn or extruded stock.

2 Claims, 1 Drawing Figure

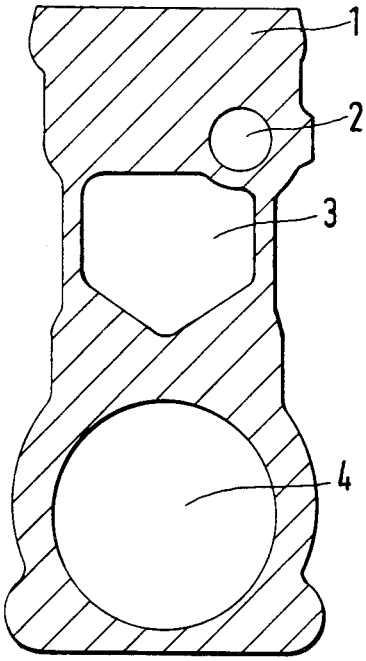
1
2
3
4

PROCEDURE FOR MANUFACTURING HYDRAULIC PLUNGER-TYPE PUMP BODIES

FIELD OF THE INVENTION

The procedure at present used for manufacturing bodies for pumps of the kind employed for injecting fuel into internal combustion engine cylinders entails, as is known, the use of a mould which is filled with moulten material of the kind which is desired to have the finished pump body made of.

While it is true that this procedure employing a mould is satisfactory once such mould has been made, it is also true that the making of the mould is a considerably complicated job which requires a long time to complete, and results in the manufacture of the pump body becoming costly.

Moreover, a different design of mould is required for each size of pump body being manufactured, in terms of the number of plungers it is to have, and this results in the manufacturing process becoming even more costly still.

If to the above factors we add others involving such things as pores, shrinkage and other defects likely to be found in the castings, and which give rise to them being rejected, then the overall increase in cost becomes highly significant and worrying too, so that the need arises for a viable solution to be found in order to extenuate the difficulties described above.

The subject of this invention comprises an unsurpassable means of overcoming these difficulties, whereby manufacturing costs are considerably reduced due to there being no need to use a preformed mould for obtaining the pump body. Moreover the procedure covered herein allows pump bodies for one or several plungers to be manufactured without the need to use moulds of differing sizes; and what is more important still, it enables all pump bodies to be produced free of flaws and defects.

The procedure which is the subject of this invention allows pump bodies to be manufactured starting with a section, made preferably from drawn aluminium, or from another material, and whose inside is provided with holes or cavities for accommodating the cam-shaft, for feeding fuel to the plungers, and for evacuating inert masses.

Such holes or cavities are incorporated in the section while it is actually being drawn, which means that including them in it involves no kind of difficulty at all.

Thereafter pumps to accommodate one or several plungers can be produced from a single kind of section, simply by cutting it to longer or shorter lengths as may be necessary in accordance with the number of plungers required.

DESCRIPTION OF THE DRAWING

Embodiments of the invention will now be more fully described by way of illustration with reference to the accompanying drawing showing a schematic arrangement of the section. This schematic arrangement is in no way to be regarded as imposing any limitations, and the embodiment may therefore be subjected to those minor alterations which do not affect its essential features.

FIG. 1 depicts a drawn aluminium section comprising the pump body.

The following notations are used in this drawing to identify the different features shown in it:

1. — Drawn aluminium section.
2. — Fuel inlet feed duct.
3. — Cavity for reducing inert masses.
4. — Camshaft housing.

In accordance with the present invention, the pump body is manufactured from section (1) produced by an extruding or drawing process.

An arrangement is included in the drawing process to produce aluminium section (1), can be embodied in it, and also fuel inlet feed duct (2), cavity for reducing inert masses (3) and finally camshaft housing (4); since all these cavities and holes can be cheaply and easily embodied in aluminium section (1) whilst it is actually being drawn rather than making them after the drawing process is over, although this latter alternative is perfectly viable too.

Once drawn aluminium section (1) has been produced, it is then only necessary to cut it into suitable lengths in accordance with whatever kind of pump body it is proposed to manufacture.

In this regard, aluminium section (1) possesses an important feature whereby when using any single kind of section, bodies for pumps with one or several plungers can be made simply by varying the length which is cut off in accordance with the requirements of the number of plungers which the finished pump body is to have.

What we claim is:

1. A method of forming a reciprocating pump body having a fuel inlet feed duct, a cavity and a cam shaft housing comprising the steps of:

a. continuously drawing a member having an outside configuration which is the outside configuration of the finished pump body;

b. said member having three longitudinal cavities therein, a first of said cavities being adapted to serve as a fuel inlet feed duct, the second of said cavities being adapted to serve as a cavity, and the third of said cavities being adapted to serve as a cam shaft housing;

c. said first, second and third cavities extending longitudinally completely through said body; and d. cutting said body to the length required to form a pump body, said cutting being performed normal to the axis of said three longitudinal cavities.

2. A method of forming a reciprocating pump body having a fuel inlet feed duct, a cavity and a cam shaft housing comprising the steps of;

a. continuously extruding a member having an outside configuration which is the outside configuration of the finished pump body;

b. said member having three longitudinal cavities therein, a first of said cavities being adapted to serve as a fuel inlet feed duct, the second of said cavities being adapted to serve as a cavity, and the third of said cavities being adapted to serve as a cam shaft housing;

c. said first, second and third cavities extending longitudinally completely through said body; and d. cutting said body to the length required to form a pump body, said cutting being performed normal to the axis of said three longitudinal cavities.

* * * * *